United States Patent [19]

Hurwitt

[11] 3,991,149

[45] Nov. 9, 1976

[54] METHOD FOR CONTROLLING THE THICKNESS OF CERAMIC TAPE

[76] Inventor: Steven Hurwitt, 159 Pascack Road, Park Ridge, N.J. 07656

[22] Filed: Oct. 3, 1974

[21] Appl. No.: 511,713

[52] U.S. Cl. ..... 264/63; 264/165; 264/171; 264/175; 264/216; 264/310; 264/313

[51] Int. Cl.[2] ..... B28B 1/30; B28B 5/00

[58] Field of Search ..... 264/212, 333, 119, 162, 264/293, 284, 296, 108, 175, 56, 63, 60, 66, 67, 64, 216, 316, 317, 57, 109, 165, 166, 171, 280, 294, 313, 310; 425/373, 404

[56] References Cited

UNITED STATES PATENTS

| | | | |
|---|---|---|---|
| 1,477,663 | 12/1923 | Poston | 264/284 |
| 1,559,948 | 11/1925 | Farris | 264/284 |
| 2,665,450 | 1/1954 | Lindquist | 264/108 |
| 2,712,154 | 7/1955 | Lindquist | 264/108 |
| 2,966,719 | 1/1961 | Park | 264/66 |
| 3,002,249 | 10/1961 | Jackson | 264/296 |
| 3,346,359 | 10/1967 | Forster et al. | 264/175 |
| 3,398,224 | 8/1968 | Spencer | 264/293 |
| T866,029 | 9/1969 | Lowe | 117/64 R |

FOREIGN PATENTS OR APPLICATIONS

| | | | |
|---|---|---|---|
| 842,129 | 5/1970 | Canada | 264/63 |

OTHER PUBLICATIONS

Schat et al., "Calendering as a Method of Forming Thin Ceramic Sheets", Proc. Brit. Ceram. Soc., 18 Aug. 1970, pp. 281–292, relied on.

*Primary Examiner*—Willard E. Hoag

[57] ABSTRACT

In the manufacture of ceramic substrates by the tape casting process, improved control of thickness variations in the "green" ceramic tape is achieved by using a free-riding roller positioned within a drying chamber at a preselected location at which the cast slip has formed a dry skin yet remains fluidly deformable. The roller pressure is adjusted to a value just sufficient to redistribute the surface of the cast slip into a straight line without changing the cross-sectional area of the tape along the line of roller contact to avoid "bubble" buildup ahead of the roller and rupture of the surface skin.

2 Claims, 3 Drawing Figures

METHOD FOR CONTROLLING THE THICKNESS OF CERAMIC TAPE

BACKGROUND OF THE INVENTION

1. Field of the Invention

This invention relates generally to the manufacture of ceramic items and particularly to improvements in the manufacture of thin flat ceramic substrates by the tape casting process.

2. Description of the Prior Art

The art of manufacturing thin flat ceramic items has been developed to meet the need for capacitor dielectrics and for substrates in microelectronic and semiconductor circuitry, among other uses. The common method for manufacturing such articles is by the tape casting process. In this process a fluid ceramic slurry, called a slip, is made by mixing together a finely ground ceramic powder, such as aluminum oxide (alumina), with suitable amounts of an organic binder, a volatile solvent, usually a plasticizer, and possibly small amounts of other materials, depending on the product requirements. Typical ingredients are identified, and the mixing and casting process are fully described in U.S. Pat. No. 2,966,719, issued to J. L. Park, Jr. on Jan. 3, 1961 as assignor to American Lava Corporation, and in U.S. Pat. No. 3,698,923, issued to H. W. Stetson et al. on Oct. 17, 1972 as assignors to Western Electric Company, Incorporated. The reader is referred to these patents and also to the earlier U.S. Pat. No. 2,582,993, issued to G. N. Howatt on Jan. 22, 1952, for details of the tape casting process and its developmental history as well as for the characteristics of the resulting ceramic product.

Briefly, the process involves discharging the above-described ceramic slip, which has a viscosity and consistency approximately the same as heavy cream, from a reservoir onto a supported, moving surface, preferably a plastic tape or film such as cellulose acetate, polytetrafluoroethylene ("Teflon"), or glycol terephthalic acid ester ("Mylar"). The film is usually in the form of an elongated strip several hundred feet long and from one half to two feet wide, wound on a storage reel mounted next to the reservoir.

The tape is led from the storage reel under the reservoir to a takeup reel, and a suitable drive mechanism moves the tape in a substantially horizontal path from the storage reel to the takeup reel. The cast slip is distributed evenly on the moving tape by an inverted dam forming the outlet of the reservoir or by a doctor blade in order to form a layer of uniform and controlled thickness.

As the layer of cast slip is conveyed on the plastic tape from the reservoir, the volatile solvents evaporate, the process of driving off the solvents being accelerated by passing the tape through an elongated, heated drying chamber. The resulting product is a ceramic tape that is aptly described as "leather hard". This tape can be punched or sliced into the shape and size desired for the substrate or other item and then be fired at high temperature (e.g. 1500° C) to produce a rigid ceramic article.

In many applications the thickness, and particularly the uniformity of thickness, of the resulting substrates must fall within very narrow tolerances. For example, the "green" tape (i.e. the leather-hard product before firing) may be 17–18 inches wide yet only 0.03 inches –0.04 inches thick and have a tolerance on thickness variation of only a few thousandths of an inch. Although the doctor blade is accurately machined and is adjustable in height over the surface of the base strip, the combined effects of irregularities in the shape of the doctor blade, gravity and surface tension of the cast slip tend to produce a variation in thickness across the width of the slip amounting to 0.003–0.007 inch or more.

Assuming best possible adjustment of the doctor blade, the effect of gravity, surface tension and shrinkage usually creates a saddle-shaped cross section in which the tape is thicker than desired near the edges and slightly thinner in the center portion. To meet the most rigid thickness variation tolerances, it is often possible to use only the center portion of the "green" tape for making substrates, which results in waste and increased cost of manufacture.

SUMMARY OF THE INVENTION

It is a primary object of the present invention to provide an improved method and apparatus for manufacturing thin flat ceramic items having closely controlled variation in thickness.

Another object of the invention is to produce "green" ceramic tape by the tape casting process that has improved uniformity of thickness.

Another object of the invention is to provide a method and apparatus for improving the uniformity of "green" ceramic tape produced by the tape casting process without introducing internal stresses in the tape.

These and other objects of the invention are achieved by use of a roller to smooth out variations in thickness of the cast slip, the location of and pressure exerted by the roller being critical elements of the invention.

The use of rollers for dimensional control in steel strip mills and the like is well known. The spacing of such rollers is carefully controlled, however, and desired ultimate gage thickness is obtained by successive reducing stages in which the strip is plastically squeezed. If a similar squeezing process is used on the "green" tape when it is almost dry, internal stresses will be created which cause warping, striations, and other defects in the finished hard ceramic product after firing.

On the other hand, a roller cannot be used when the slip is still liquid because the slip will stick to the roller. As the cast slip proceeds on its way through the drying chamber, however, the volatile solvent evaporates first from the region close to the exposed surface to form a dry, flexible skin at a location in the chamber. At this point, the interior of the cast slip remains fluid; so that the surface shape of the solidifying tape can be redistributed without creating unrelieved internal stresses.

Accordingly, the method of the present invention includes the steps of selecting a location in the drying chamber at which the layer of cast slip has developed a dry surface skin yet remains fluidly deformable, of rotatably mounting a cylindrical roller above the surface of the ceramic layer at the selected location with its axis parallel to the supporting tape and transverse to the direction of tape movement, and of resiliently biasing the roller into contact with the surface of the ceramic layer with a predetermined force.

The value of the predetermined force is critical to the successful practice of the method. The force must be sufficient to redistribute the surface of the layer in contact with the roller into a straight line but not so great as to break the surface skin. If the skin breaks, the liquid interior will be exposed and stick to the roller, requiring the line to be stopped and the roller cleaned.

The optimum roller pressure occurs when all hills and valleys are flattened across the full width of the ceramic layer, but the cross-sectional area has not been reduced. If this optimum pressure is exceeded, a small transverse ridge or "bubble" will start to form in front of the roller as the liquid interior is squeezed from under the roller. This bubble will grow progressively larger until the surface tension becomes so great that the skin will break.

It is of great importance that the roller be free riding; that is, that it not be a fixed distance above the ceramic layer support surface. Otherwise, thickness variations occurring longitudinally, for example as a result of changes in the rate of travel of the supporting tape, could create intermittent "bubble" buildup or incomplete flattening of surface irregularities. Instead, the pressure exerted by the roller should be constant at the optimum predetermined value.

The above features are provided by the apparatus of the invention, which includes a cylindrical roller having a length at least equal to the width of the layer of ceramic slip; means for mounting the roller for free rotation about its axis and for translation toward and away from the surface of the layer of ceramic slip, with the axis of the roller positioned parallel to the supporting surface for the ceramic layer and transverse to the direction of movement thereof; and means for biasing the roller into contact with the surface of the ceramic layer with a predetermined force sufficient to redistribute the surface of the layer in contact with the roller into a straight line without breaking the skin formed thereon.

In a preferred embodiment, the means for mounting the roller comprises a fixed support, a rotor support frame, means for rotatably mounting the rotor in the support frame, and means for mounting the frame for pivoting movement about an axis parallel to and offset horizontally from the rotor axis. In effect, the rotor is mounted on a lever arm for freely riding on the surface of the ceramic layer.

The preferred biasing means includes a balance weight and means for adjustably mounting the balance weight on the frame for selectively varying the net force exerted by the roller on the surface of the ceramic layer. Spring biasing means may be used instead of the balancing weight, but the weight is preferred for ease of adjustment and constancy of force.

The above and other features of the present invention will be apparent from the following description of the preferred embodiments and the accompanying drawings.

DESCRIPTION OF THE PREFERRED EMBODIMENTS

Figure 1:
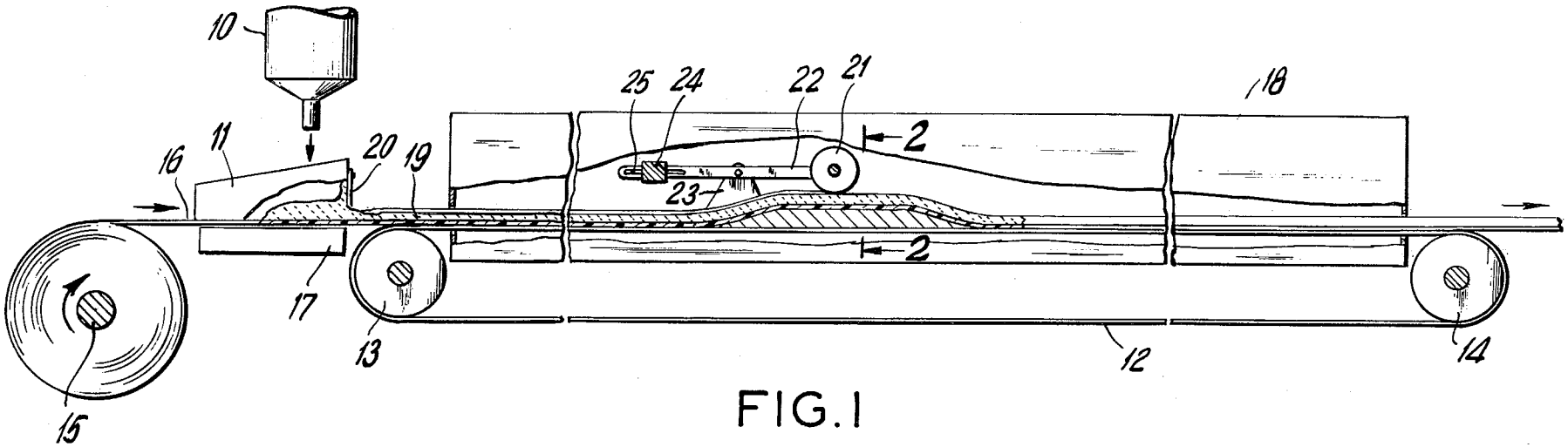
FIG. 1 is a side view, in partial section, of a mechanically schematic representation of a tape casting system incorporating the improved thickness control means of the present invention.

Referring to FIG. 1, a reservoir 10 for a ceramic slip mixture is located above a distribution station in the form of an inverted-weir box 11 near one end of a conveying means represented by an endless conveyor belt 12 trained around spaced rollers 13 and 14. A storage reel 15 positioned near the entrance to the conveyor is wound with an elongated tape or sheet of flexible plastic film 16. The film may be cellulose acetate, "Mylar", "Teflon", or other material, preferably from ½ – 2 feet wide and about 0.002 – 0.020 inch thick.

Film 16 is led from the storage reel over a support plate 17 onto the conveyor belt 12 and thence into a drying chamber 18. From the other end of the drying chamber the tape proceeds to a takeup reel (not shown). Conventional motor drive means (not shown) rotate the conveyor rollers and the takeup reel to move the plastic film at a substantially constant rate from the storage reel to the takeup reel. The plastic film provides a moving, flat, support surface for conveying a layer 19 of ceramic slip distributed evenly onto the surface of the film at a predetermined thickness by an adjustable doctor blade 20 mounted at the open end of weir box 11.

The thickness of the cast slip is determined by the height of the doctor blade above the surface of the support film, the speed of movement of the film, the viscosity of the slip, and the head of the slip in the weir box. A typical layer thickness may be 0.035 – 0.038 inch, but thinner and thicker layers may be made, depending on the requirements for the fired ceramic end product, by techniques well known to those skilled in the art.

As described earlier, the slip comprises a mixture of finely ground ceramic material, a volatile solvent, a suitable organic binder, and possibly other ingredients such as a wetting agent, a plasticizer, and so forth. The volatile solvent begins to evaporate from the surface of the cast slip immediately upon entering the drying chamber 18; so that at some point within the chamber a dry skin forms on the surface of the slip, while the interior remains in a liquid state.

The combined effect of gravity, surface tension, and shrinkage as the skin forms tends to deform the upper surface of the cast slip into a saddle-shaped cross section, high near the edges and low in the center. This departure from non-uniformity of thickness may be less than 0.01 inch over the full width of the tape, but for many high-precision applications such variation is too much. Furthermore, the non-uniform thickness condition resulting from the initial drying process may be aggravated by irregularities in the doctor blade profile or by non-parallelism of the blade with the support surface for the plastic film.

According to the present invention, a free riding roller 21 is rotatably mounted in a frame 22 that is pivotally supported on a fixed support 23 at a preselected location at which the cast slip has formed a dry skin strong enough to permit some amount of pressure without breaking yet still remains sufficiently liquid underneath the skin to accommodate surface deformation without creating internal stresses.

The pivot axis of the frame on the fixed support is offset horizontally from the rotational axis of the roller to allow the roller to move freely toward and away from the surface of the ceramic layer. A balance weight 24 is adjustably mounted on frame 22, as by a threaded rod 25, for selectively varying the net force exerted by the roller on the surface of the ceramic layer. This net force is a critical factor in the operation of the roller and is typically of the order of a few pounds.

The pivot connection of the frame to the fixed support preferably includes means (not shown) for vertical adjustment to establish exact parallelism of the rotor axis to a precision flat support saddle plate 26 to insure that there will be no side-to-side taper in the thickness of the smoothed slip after it passes under the roller.

Figure 2:
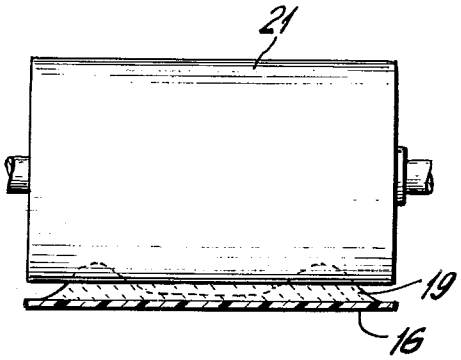
FIG. 2 is a cross-sectional view (not to scale) of the cast tape layer taken in the direction of arrows 2—2 in FIG. 1.

As shown in highly exaggerated vertical dimensions in FIG. 2, the cross-sectional surface profile of the slip prior to passing under the roller (dashed lines) is saddle-shaped with high ends and a low center. As the slip passes under the roller, the side portions are flattened and the center portion correspondingly raised to produce a straight-line profile uniformly spaced above plastic support tape 16.

As pointed out earlier, the net contact force of the roller is adjusted so that the redistribution of the surface profile is accomplished without changing the cross-sectional area of the ceramic layer at the line of contact with the roller. In other words, the contact force must be just enough to "iron" the layer to a uniform thickness without "squeezing" it. This optimum condition is reached when there is no significant lateral ridge or "bubble" formed ahead of the roller (i.e. on the left side of the roller in FIG. 1) as the ceramic layer advances to the right. If such a "bubble" does form, the increased surface tension at that point tends to rupture the skin, thereby allowing liquid slip to contact and stick to the roller.

Figure 3:
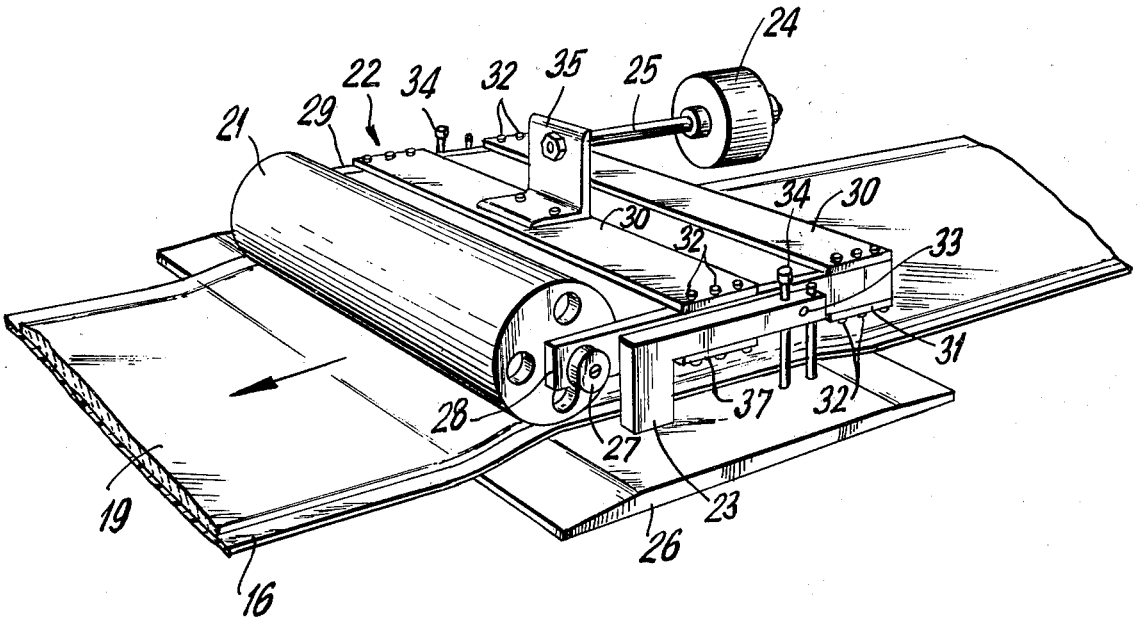
FIG. 3 is a perspective view of a preferred embodiment of the thickness control apparatus of the invention.

Referring to FIG. 3, a preferred embodiment of the apparatus of the invention includes a hollow, precision ground roller 21 mounted in ball bearings 27 fitted to the ends of parallel side bars 28 and 29 of frame 22. The side bars are joined together by upper cross bars 30 and lower cross bars 31, attached to the side bars by machine screws 32 to form a rigid frame for accurately maintaining the rotor axis parallel to the surface of saddle plate 26.

Frame 22 is mounted by a pivot pin 33 in a fixed support 23 on each side of the frame. The height of each pivot pin above the saddle plate can be adjusted by screws 34 to obtain exact parallelism of the rotor with the saddle plate.

An angle bracket 35 carries threaded rod 25 upon which is mounted balance weight 24 in an easily accessible position for adjusting the net force exerted by the roller. The optimum net force can be easily determined by rotating the weight on the threaded rod to increase the rotor contact pressure until a "bubble" forms ahead of the roller and then backing off the weight until the "bubble" disappears. At this point, the surface of the ceramic layer is being redistributed into a straight line under the roller without any decrease in the cross-sectional area.

Although the embodiment of FIG. 3 is preferred for simplicity, rigidity, and ease of adjustment, it will be appreciated that other apparatus designs for accomplishing the same function fall within the scope of the invention.

I claim:

1. In a process of manufacturing ceramic substrates that includes mixing finely ground ceramic material with a volatile solvent and binder to form a slip, spreading the slip at a distribution station in a thin even layer onto a continuously moving flat surface, and conveying the thin ceramic layer on the moving flat surface to a drying chamber for evaporating the volatile solvent to form a leather-hard tape which can be cut to size and subsequently fired at high temperature to create thin ceramic plates, the improvement for obtaining uniform thickness of the ceramic tape comprising: passing said layer beneath a rotatable cylindrical roller at a location in the drying chamber at which the surface of the ceramic layer has formed a dry skin but the interior of the layer remains liquid, the roller being mounted for translation toward and away from the surface of the layer with its axis parallel to the flat surface and transverse to the conveying direction and resiliently biasing the roller into contact with the surface of the ceramic layer with a predetermined substantially constant force sufficient to redistribute portions of the layer to flatten the surface of the layer in contact with the roller while leaving intact the skin formed on the layer then completing drying of said layer.

2. The process of claim 1 wherein the biasing force is just sufficient to redistribute the surface of the layer without substantially changing the cross-sectional area of the layer at the line of contact with the roller.

* * * * *